US009296211B2

(12) United States Patent
Ozaki

(10) Patent No.: US 9,296,211 B2
(45) Date of Patent: Mar. 29, 2016

(54) INKJET HEAD CLEANING DEVICE AND CLEANING METHOD, AND INKJET PRINTING DEVICE

(71) Applicant: FUJIFILM Corporation, Tokyo (JP)

(72) Inventor: Yuichi Ozaki, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/665,520

(22) Filed: Mar. 23, 2015

(65) Prior Publication Data

US 2015/0191018 A1 Jul. 9, 2015

Related U.S. Application Data

(63) Continuation of application No. PCT/JP2013/076655, filed on Oct. 1, 2013.

(30) Foreign Application Priority Data

Oct. 4, 2012 (JP) ..... 2012-221957

(51) Int. Cl.
*B41J 2/165* (2006.01)

(52) U.S. Cl.
CPC ..... *B41J 2/16535* (2013.01); *B41J 2/16588* (2013.01); *B41J 2002/1655* (2013.01); *B41J 2002/16558* (2013.01); *B41J 2002/16591* (2013.01)

(58) Field of Classification Search
CPC ..... B41J 2/16552; B41J 2/16535; B41J 2/16538; B41J 2/165; B41J 2/16541; B41J 2/16588; B41J 2002/1655; B41J 2002/16558; B41J 2002/16591
USPC ..... 347/22, 28, 33
See application file for complete search history.

(56) References Cited

U.S. PATENT DOCUMENTS

2007/0247484 A1 10/2007 Sanada et al.
2010/0245466 A1 9/2010 Inoue

FOREIGN PATENT DOCUMENTS

JP 2006-205714 A 8/2006
JP 2010-234666 A 10/2010
JP 2010-274533 A 12/2010
JP 2012-171279 A 9/2012
JP 2012-171346 A 9/2012

OTHER PUBLICATIONS

International Search Report; PCT/JP2013/076655; Nov. 5, 2013.
Written Opinion of the International Searching Authority; PCT/JP2013/076655; Nov. 5, 2013.
Notification of Transmittal of Translation of the International Preliminary Report on Patentability and Translation of Written Opinion of the International Searching Authority; PCT/JP2013/076655; issued on Apr. 16, 2015.

*Primary Examiner* — Jannelle M Lebron
(74) *Attorney, Agent, or Firm* — Studebaker & Brackett PC

(57) ABSTRACT

An inkjet head cleaning device for an inkjet head having a nozzle surface on which nozzles for ejecting ink are arranged, includes a wiping member traveling unit allowing a wiping member of elongated shape having absorbency to travel along a conveying path in a longitudinal direction, a cleaning liquid supply unit supplying a cleaning liquid to the wiping member, a pressing unit pressing and bringing the wiping member supplied with the cleaning liquid to and into contact with the nozzle surface, and a sliding unit relatively sliding the wiping member and the nozzle surface, in which the nozzle surface is cleaned by putting a state of a mixed liquid of the ink and the cleaning liquid at a contacting portion between the wiping member and the nozzle surface into a state satisfying a predetermined relationship represented by a relationship between a surface tension and viscosity of the mixed liquid.

6 Claims, 8 Drawing Sheets

EXAMPLE OF NOZZLES PROJECTED IN DIRECTION PERPENDICULAR TO SHEET CONVEYING DIRECTION

INKJET HEAD CLEANING DEVICE AND CLEANING METHOD, AND INKJET PRINTING DEVICE

CROSS-REFERENCE TO RELATED APPLICATIONS

This application is a Continuation of PCT International Application No. PCT/JP2013/076655 filed on Oct. 1, 2013, which claims priority under 35 U.S.C §119(a) to Japanese Patent Application No. 2012-221957 filed on Oct. 4, 2012. Each of the above applications is hereby expressly incorporated by reference, in their entirety, into the present application.

BACKGROUND OF THE INVENTION

1. Field of the Invention

The present invention relates to an inkjet head cleaning device and cleaning method, and an inkjet printing device, and particularly relates to head cleaning technology for wiping a nozzle surface of an inkjet head using a wiping member supplied with cleaning liquid.

2. Description of the Related Art

A dirty nozzle surface (surface where a nozzle is formed) of a head in an inkjet printing device causes ejection failure. For this reason, the nozzle surface is periodically cleaned.

As a method for cleaning the nozzle surface, there have been known in the past a cleaning method of wiping the nozzle surface by a blade, a cleaning method of wiping the nozzle surface by a web, and the like.

Japanese Patent Application Laid-Open No. 2010-274533 (PTL 1) discloses a head maintenance device including a drop nozzle dropping cleaning liquid that is an ink solvent onto a cleaning cloth, in which the cleaning cloth in a state of being wetted with the ink solvent is conveyed to a cleaning position to absorb and remove the ink droplet on the nozzle surface.

According to the technology in PTL 1, even if the ink droplet deposited on the nozzle surface becomes thickened due to a dry atmosphere or the like, a concentration difference between the cleaning liquid seeping into the cleaning cloth and the thickened ink droplet generates an osmotic pressure action such that the ink droplet deposited on the nozzle surface is effectively absorbed and removed.

However, in the technology in PTL 1, a mixed liquid of the ink and the cleaning liquid remains on the head nozzle surface after cleaning in some cases. If the mixed liquid remains on the head nozzle surface, problems may occur, for example, the mixed liquid is connected with meniscus of the nozzle, the mixed liquid remaining on the nozzle surface is dried and gets into the nozzle in wiping next time, a long time contact between the nozzle surface and the mixed liquid causes a liquid repellent film of the nozzle surface to deteriorate, and the like.

Therefore, in order to prevent the mixed liquid from remaining on the nozzle surface, physical properties of the mixed liquid need to be considered.

On the other hand, Japanese Patent Application Laid-Open No. 2006-205714 (PTL 2) discloses a technology in which a surface is cleaned by supplying head liquid to a surface of an inkjet head and performing wiping operation such that relationship among surface tension of the surface of the inkjet head, surface tension of an ink, and surface tension of the head liquid satisfies a predetermined condition, and thereby, surface tension of an ink residue mixed liquid with respect to a deposited surface is made higher than that of the ink residue only, and materials of a wiper blade are selected in terms of the ink residue mixed liquid.

According to the technology in PTL 2, the mixed liquid can be easily removed from the nozzle surface.

SUMMARY OF THE INVENTION

However, the present application inventor has found as a result of earnest study that it is not enough to specify the surface tension of the mixed liquid in order to clean the nozzle surface with no remaining liquid.

The present invention has been made in consideration of such a circumstance, and has an object to provide an inkjet head cleaning device and cleaning method, and an inkjet printing device in which a nozzle surface can be cleaned with no remaining liquid by controlling physical properties of mixed liquid.

In order to achieve the above object, an aspect of an inkjet head cleaning device is an inkjet head cleaning device for an inkjet head having a nozzle surface on which nozzles configured to eject ink are arranged, including a wiping member traveling unit allowing a wiping member of elongated shape having absorbency to travel along a conveying path in a longitudinal direction, a cleaning liquid supply unit configured to supply a cleaning liquid to the wiping member, a pressing unit configured to press and bring the wiping member supplied with the cleaning liquid to and into contact with the nozzle surface, and a sliding unit configured to slide the pressing unit along the nozzle surface, in which the nozzle surface is cleaned by way of putting a state of a mixed liquid of the ink and the cleaning liquid at a contacting portion between the wiping member and the nozzle surface into a state satisfying a predetermined relationship represented by a relationship between a surface tension and viscosity of the mixed liquid.

According to the aspect, a state of the mixed liquid of the ink adhered to the nozzle surface and the cleaning liquid supplied to the wiping member is put into a state satisfying a predetermined relationship represented on the basis of the relationship between the surface tension and the viscosity, wiping and cleaning the nozzle surface with no remaining liquid.

It is preferable to control at least one of a traveling speed of the wiping member traveling unit, a cleaning liquid amount supplied by the cleaning liquid supply unit, a sliding speed of the sliding unit, and a cleaning frequency of the inkjet head to put the state of the mixed liquid into the state satisfying the predetermined relationship. This allows the state of the mixed liquid to be appropriately put into the state satisfying a predetermined relationship.

It is preferable that the predetermined relationship is defined for each liquid repellent performance of the nozzle surface. This allows the nozzle surface to be wiped and cleaned with no remaining liquid in a case where the liquid repellent performance of the nozzle surface is varied.

It is preferable that the predetermined relationship is a relationship calculated by experimentally finding presence or absence of residue on the nozzle surface upon cleaning the nozzle surface regarding a plurality of mixed liquids different in the surface tension and the viscosity. This can appropriately define the relationship of mixed liquids.

It is preferable that, in a graph plotting a result obtained from the presence or absence of the residue regarding the plurality of mixed liquids with an abscissa axis of surface tensions of various mixed liquids and an ordinate axis of viscosities of the mixed liquid, assuming a border line between the presence and absence of the residue calculated from the plotted graph, the predetermined relationship is a relationship satisfying an area on a no-residue side of the border line. This allows the nozzle surface to be wiped and cleaned with no remaining liquid.

It is preferable that the cleaning liquid supply unit supplies the cleaning liquid in an amount which gets the absorbency of the wiping member into a saturated condition. This enables a stable wiping and cleaning.

It is preferable that the control unit controls the cleaning frequency of the inkjet head assuming a state where the ink maximally adheres to the nozzle surface. This allows the nozzle surface to be appropriately wiped and cleaned.

In order to achieve the above object, an aspect of an inkjet printing device is an inkjet printing device, including an inkjet head having a nozzle surface on which nozzles for ejecting ink are arranged, a recording unit relatively moving the inkjet head and a recording medium while ejecting the ink from the nozzle for recording on recording medium, and the inkjet head cleaning device described above.

According the aspect, even in a case where the ink adheres to the nozzle surface when the ink is ejected from the nozzle for recording on the recording medium, a state of the mixed liquid of the ink adhered to the nozzle surface and the cleaning liquid supplied to the wiping member is put into a state satisfying a predetermined relationship represented on the basis of the relationship between the surface tension and the viscosity, wiping and cleaning the nozzle surface with no remaining liquid.

It is preferable that the inkjet head further including a wetting unit configured to wet the nozzle, and a moving unit configured to move the inkjet head between a recording position for recording on the recording medium by the recording unit and a wet position for wetting the nozzle by the wetting unit, in which the inkjet head cleaning device is arranged between the recording position and the wet position. This allows the nozzle surface to be wiped and cleaned upon moving the inkjet head from the recording position to the wet position.

In order to achieve the above object, an aspect of an inkjet head cleaning method is a cleaning method of an inkjet head having a nozzle surface on which nozzles configured to eject ink are arranged, including a wiping member traveling step of allowing a wiping member of elongated shape having absorbency to travel along a conveying path in a longitudinal direction, a cleaning liquid supply step of supplying a cleaning liquid to the wiping member, a pressing step of pressing and bringing the wiping member supplied with the cleaning liquid to and into contact with the nozzle surface, and a sliding step of sliding the pressing unit along the nozzle surface, in which the nozzle surface is cleaned by way of putting a state of a mixed liquid of the ink and the cleaning liquid at a contacting portion between the wiping member and the nozzle surface into a state satisfying a predetermined relationship represented on the basis of a relationship between a surface tension and viscosity of the mixed liquid.

According to the aspect, a state of the mixed liquid of the ink adhered to the nozzle surface and the cleaning liquid supplied to the wiping member is put into a state satisfying a predetermined relationship represented on the basis of the relationship between the surface tension and the viscosity, therefore, it is possible to clean the nozzle surface with no remaining liquid.

According to the invention, the nozzle surface on which the ink is deposited can be cleaned with no remaining liquid by use of the wiping member supplied with the cleaning liquid. This can stabilize printing accuracy by way of the inkjet head.

DETAILED DESCRIPTION OF EXEMPLARY EMBODIMENTS

Hereinafter, a description is given in detail of preferred embodiments of the invention with reference to the drawings.

<Apparatus Configuration of Inkjet Printing Device>

Figure 1:
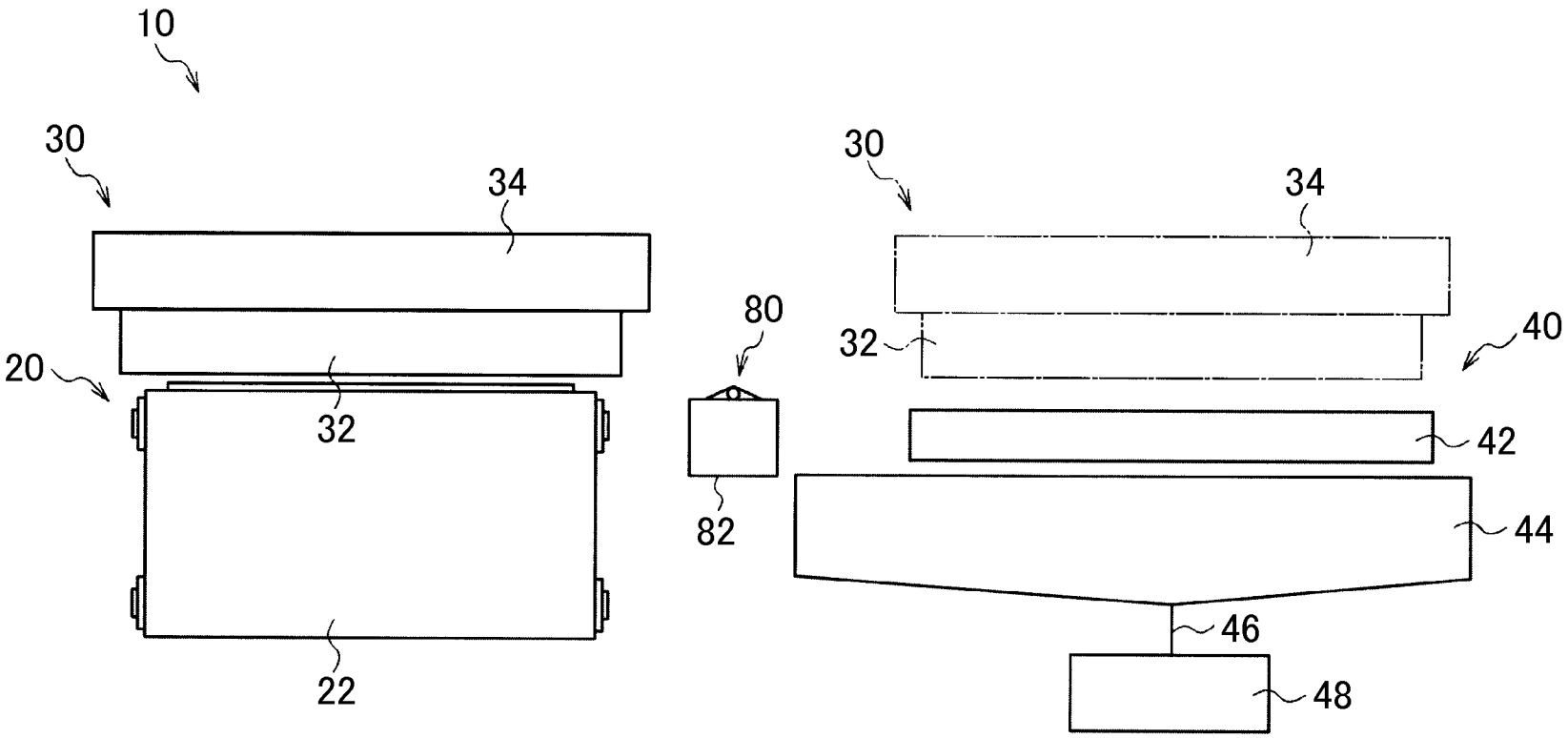
FIG. 1 is a front view illustrating a main part configuration of an inkjet printing device.
Figure 2:
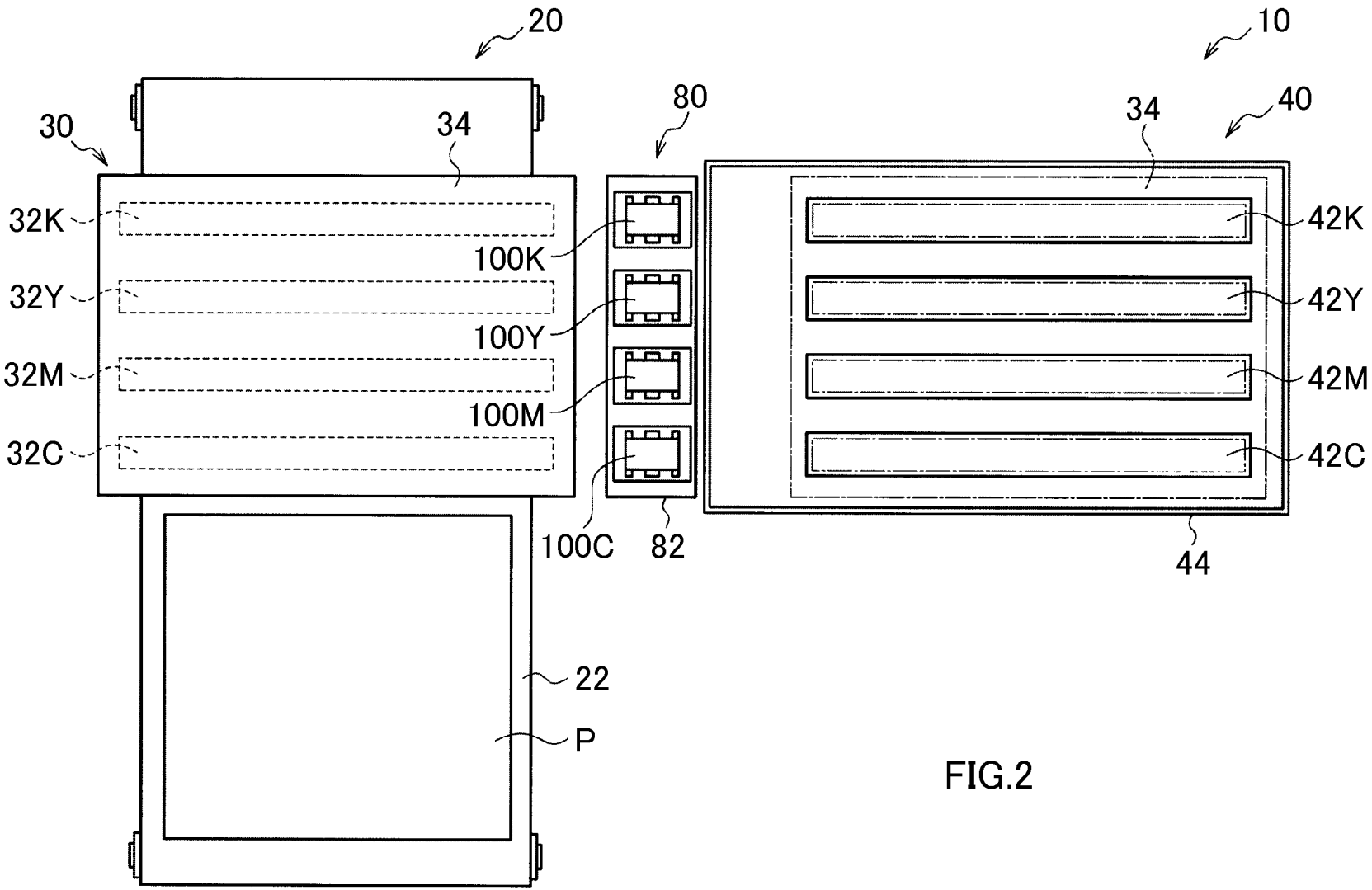
FIG. 2 is a plan view illustrating the main part configuration of the inkjet printing device.
Figure 3:
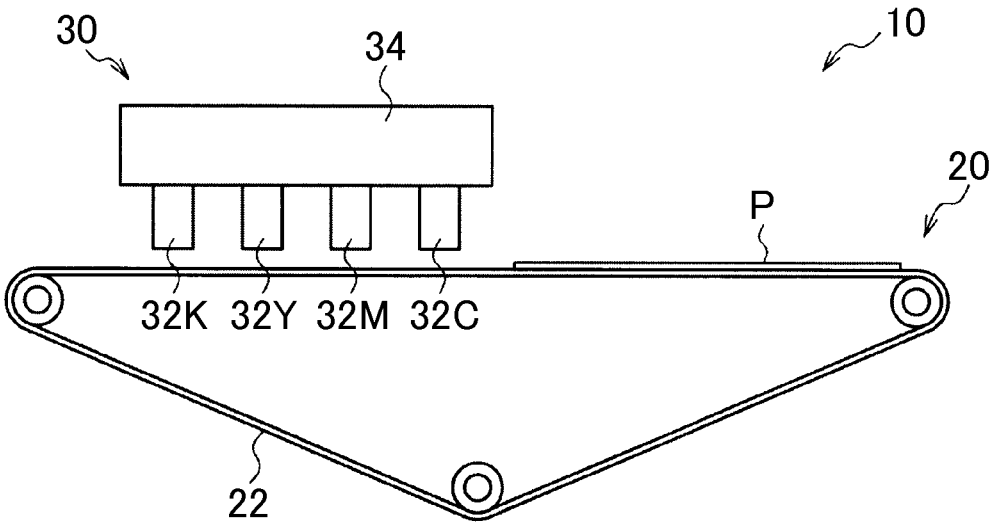
FIG. 3 is a side view illustrating the main part configuration of the inkjet printing device.

FIG. 1 to FIG. 3 are a front view, plan view, and side view, respectively, of a main part configuration of an inkjet printing device in this embodiment.

As illustrated in the figures, an inkjet printing device 10, which is a line printer of single-path system, mainly includes a paper sheet conveyance mechanism 20 (an example of a recording unit) for conveying a paper sheet (printer sheet) P as a recording medium, a head unit 30 (an example of a recording unit) for ejecting ink droplets of colors of cyan (C), magenta (M), yellow (Y), and black (K) toward the paper sheet P conveyed by the paper sheet conveyance mechanism 20, a maintenance unit 40 for maintaining each head mounted on the head unit 30, and a nozzle surface cleaning device 80 (inkjet head cleaning device) for cleaning a nozzle surface of each head mounded on the head unit 30.

The paper sheet conveyance mechanism 20, which includes a belt conveyance mechanism, horizontally conveys the paper sheet P with the paper sheet P being suctioned to a belt 22 in traveling.

The head unit 30 includes a head 32C ejecting ink droplets of cyan, a head 32M ejecting ink droplets of magenta, a head 32Y ejecting ink droplets of yellow, a head 32K ejecting ink droplets of black, a head support frame 34 having the heads 32C, 32M, 32Y, and 32K attached thereto, and a head support frame movement mechanism (not illustrated) for moving the head support frame 34.

The heads (inkjet head) 32C, 32M, 32Y, and 32K each include a line head corresponding to a maximum paper width of the paper sheet P which is a printing object. Note the heads 32C, 32M, 32Y, and 32K have the same configuration, and thus, are referred to as the head 32 in the following description except when specifically distinguished.

The head 32 (32C, 32M, 32Y, or 32K) is formed into a rectangular block shape and has a nozzle surface 33 (33C, 33M, 33Y, or 33K) formed on a bottom thereof.

Figure 4:
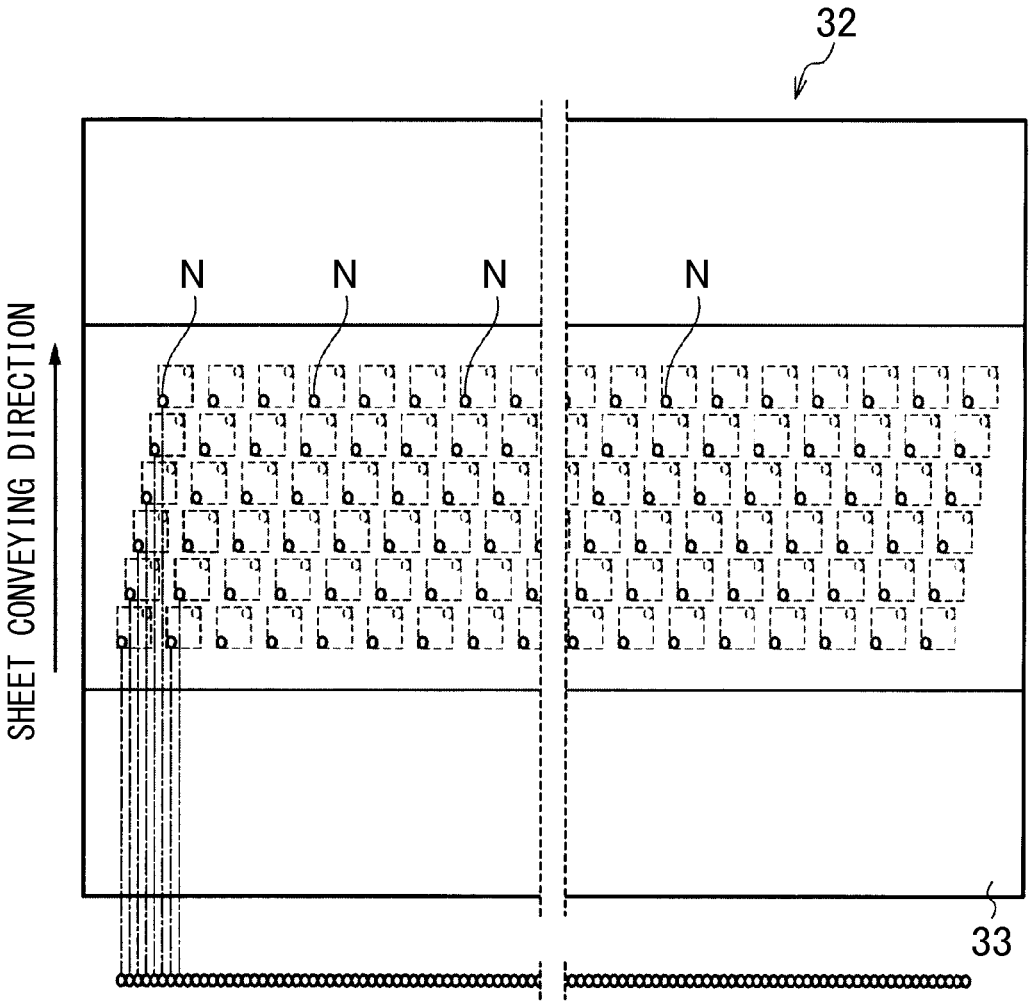
FIG. 4 is a plan transparent view of a nozzle surface of a head.

FIG. 4 is a plan transparent view of the nozzle surface of the head.

The nozzle surface 33 is formed into a rectangle shape and has nozzle rows formed thereon along its longitudinal direction. The head 32 in this embodiment includes a so-called matrix head in which nozzles N are arranged in a two-dimensional matrix. The matrix head can have a substantial distance narrowed between the nozzles N projected in the longitudinal direction of the head 32 to allow a density of the nozzles N to be increased.

The head 32 in this embodiment ejects the ink droplets from the nozzle N by a so-called piezoelectric method. Each nozzle N is communicated with a pressure chamber and a wall face of the pressure chamber is vibrated by a piezo element to eject an ink droplet from the nozzle N. The ink ejection method is not limited to this and the head may be configured to use a thermal printing method for ejection.

The head support frame 34 has a head attachment part (not illustrated) for attaching each head 32. Each head 32 is detachably attached to the head attachment part.

Each head 32 attached to the head support frame 34 is arranged perpendicularly to a conveying direction of the paper sheet P. The heads are arranged in a certain order at a certain interval along the conveying direction of the paper sheet P (arranged in the order of cyan, magenta, yellow, and black in this example).

The head attachment part is liftably provided to the head support frame 34 to be lifted and lowered by a lifting and lowering mechanism not illustrated in the figure. Each head 32 attached to the head attachment part is lifted and lowered perpendicularly to a conveying surface of the paper sheet P by the lifting and lowering mechanism.

The head support frame movement mechanism slides the head support frame 34 horizontally in a direction perpendicular to the conveying direction of the paper sheet P at a position above the paper sheet conveyance mechanism 20.

The head support frame movement mechanism includes, for example, a ceiling frame horizontally provided across the paper sheet conveyance mechanism 20, a guide rail laid on the ceiling frame, a traveling member slid and moved on the guide rail, and a driving unit moving the traveling member along the guide rail (e.g., feed screw mechanism). The head support frame 34 is attached to the traveling member to horizontally slide and move.

The head support frame 34 is provided so as to be driven by the head support frame movement mechanism to be movable between a predetermined "image recording position (recording position)" and a "maintenance position (wet position)".

The head support frame 34, in positioning at the image recording position, is located above the paper sheet conveyance mechanism 20. This allows printing with respect to the paper sheet P conveyed by the paper sheet conveyance mechanism 20.

On the other hand, the head support frame 34, in positioning the maintenance position, is located at an arrangement position of the maintenance unit 40.

The maintenance unit 40 includes caps 42 (42C, 42M, 42Y, and 42K) covering the nozzle surfaces 33 of each head 32. When the apparatus is stopped for a long time or the like, the head 32 is moved to the arrangement position (maintenance position) of the maintenance unit 40 to cover the nozzle surface 33 by the cap 42. This prevents non-ejection caused by dryness.

The cap 42 includes a pressurizing and suctioning mechanism (not illustrated) for pressurizing and suctioning an inside of a nozzle, and a cleaning liquid supply mechanism (not illustrated) for supplying cleaning liquid inside the cap 42. A waste liquid tray 44 is arranged at a position below the cap 42. The cleaning liquid supplied to the cap 42 is discarded in the waste liquid tray 44 and is collected from the waste liquid tray 44 via a waste liquid collecting pipe 46 into a waste liquid tank 48.

The nozzle surface cleaning device 80 is arranged between the paper sheet conveyance mechanism 20 and the maintenance unit 40. The nozzle surface cleaning device 80 wipes the nozzle surface 33 of the head 32 by a wiping web supplied with the cleaning liquid to clean the nozzle surface 33 when the head support frame 34 moves from the image recording position to the maintenance position.

<Apparatus Configuration of Nozzle Surface Cleaning Device>

The nozzle surface cleaning device 80 includes wiping units 100C, 100M, 100Y, and 100K attached to a wiping device main body frame 82, and a wiping device main body lifting and lowering mechanism (not illustrated) for lifting and lowering the wiping device main body frame 82.

The wiping units 100C, 100M, 100Y, and 100K allow a wiping web (reference numeral 112 in FIG. 5) which is formed into a belt to travel while the wiping web being made to contact with the nozzle surface 33 of the head 32 for cleaning the nozzle surface 33. The wiping units 100C, 100M, 100Y, and 100K which are provided for the respective heads are arranged in the wiping device main body frame 82 so as to correspond to arrangement intervals of the head 32. The wiping units 100C, 100M, 100Y, and 100K have the same configuration, and thus, here, the wiping unit 100 is used as a representative thereof and a description is given of a configuration thereof.

Figure 5:
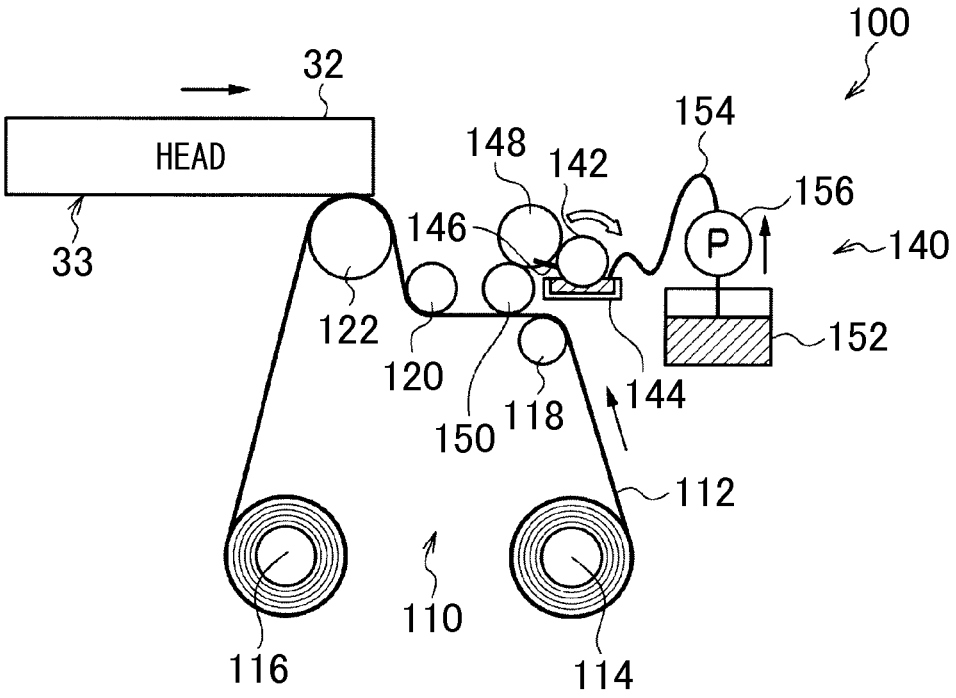
FIG. 5 is a schematic view illustrating a general configuration of a wiping unit.

FIG. 5 is a schematic view illustrating a general configuration of the wiping unit 100. As illustrated in the figure, the wiping unit 100 includes a conveying unit 110 conveying the wiping web 112, and a cleaning liquid supply unit 140 supplying the wiping web 112 with the cleaning liquid.

(Configuration of Conveying Unit)

The conveying unit 110 is configured to include a feed side web core 114 feeding the wiping web 112 before wiping, a take-up side web core 116 (an example of a wiping member traveling unit) which is rotatably driven by a take-up motor (reference numeral 210 in FIG. 6) to wind the wiping web 112 after wiping, a first guide roll 118 which is brought into contact with the wiping web 112 fed from the feed side web core 114 to be rotated for guiding toward the cleaning liquid supply unit 140, a second guide roll 120 which is brought into contact with the wiping web 112 fed from the cleaning liquid supply unit 140 to be rotated for guiding toward a press roll 122, and the press roll 122 (an example of a pressing unit) bringing the wiping web 112 into contact with the nozzle surface 33 of the head 32 at a predetermined pressure.

The wiping web 112 (an example of wiping member of elongated shape) is formed of a sheet of knitted or woven microfiber of polyethylene terephthalate, polyethylene, nylon and the like, for example, and formed into a belt shape having a width corresponding to a width of the nozzle surface 33 of the head 32. The wiping web 112 is provided in a state of being wound around the feed side web core 114 into a rolled shape with the other tip end being fixed to the take-up side web core 116.

The feed side web core 114 is mounted to be fitted into a feed shaft (not illustrated) which has one end thereof fixed to be horizontally supported. The feed shaft has a double tube structure in which an outer cylinder is supported rotatably around an inner cylinder. A reverse rotation prevention mechanism and a friction mechanism are arranged between the inner cylinder and the outer cylinder whereby the outer cylinder is configured to rotate in one direction only (feed direction of the wiping web 112) accompanied by a certain resistance.

The take-up side web core 116 is mounted to be fitted into a take-up shaft (not illustrated) which is horizontally supported to be rotatable. The take-up shaft is coupled with the take-up motor whereby the take-up side web core 116 is driven by the take-up motor to rotate in one direction (take-up direction of the wiping web 112).

The take-up shaft has a double structure in which an outer cylinder is supported rotatably around an inner cylinder. A torque limiter is arranged between the inner cylinder and the outer cylinder whereby the outer cylinder is configured to slide with respect to the inner cylinder when a load (torque) above a certain level is put. This can prevent an excessive tension from being exerted on the wiping web 112.

The first guide roll 118 is supported to be rotatable by a shaft which is horizontally provided (not illustrated) to guide the wiping web 112 fed from the feed side web core 114 toward the cleaning liquid supply unit 140.

The second guide roll 120 is supported to be rotatable by a shaft which is horizontally provided (not illustrated) to guide the wiping web 112 fed from the cleaning liquid supply unit 140 toward the press roll 122.

The press roll 122 is horizontally provided with one end of a portion of the shaft thereof supported to be rotatable. The press roll 122 is formed of a rubber roll having a width corresponding to that of the wiping web 112 to bring the wiping web 112 into contact with the nozzle surface 33 of the head 32 at a predetermined pressure.

Here, as described above, the wiping web 112 is provided in a state of being wound around the feed side web core 114 into a rolled shape, and thus, undergoes mounting to (replacement with) the wiping unit 100 in this state also. Specifically, the feed side web core 114 is mounted to be fitted into the feed shaft, followed by wrapping the web on the first guide roll 118, the second guide roll 120, and the press roll 122 in this order and fitting the take-up side web core 116 into the take-up shaft to complete the mounting.

(Configuration of Cleaning Liquid Supply Unit)

The cleaning liquid supply unit 140 (an example of a cleaning liquid supply unit) is configured to include an anilox roll 142, a cleaning liquid tray 144 where a part of the anilox roll 142 is immersed in the cleaning liquid reserved, a doctor blade 146 brought into contact with the anilox roll 142 to remove the cleaning liquid excess on the surface thereof, an intermediate roll 148 brought into contact with the anilox roll 142 to be rotated, a transfer roll 150 brought into contact with the intermediate roll 148 to be rotated, a cleaning liquid tank 152 in which the cleaning liquid is reserved, a cleaning liquid pipe 154 linking the cleaning liquid tank 152 to the cleaning liquid tray 144, and a cleaning liquid pump 156 sending the cleaning liquid from the cleaning liquid tray 144 to the cleaning liquid tray 144.

The anilox roll 142, which is a roll having many cells formed on a surface thereof for retaining the cleaning liquid, has a width corresponding to that of the wiping web 112. The anilox roll 142 is configured to be rotatable in a predetermined direction (clockwise direction in the example of FIG. 5) by a drive motor (reference numeral 214 in FIG. 6).

The cleaning liquid tray 144 reserves the cleaning liquid. A part of the anilox roll 142 is immersed in the cleaning liquid in the cleaning liquid tray 144.

The doctor blade 146, which is a metal thin plate having a width corresponding to that of the anilox roll 142, is held with one end thereof being biased to be pressed to a cylindrical periphery of the anilox roll 142.

The intermediate roll 148, which is a roll having a width corresponding to that of the anilox roll 142, is brought into contact with the anilox roll 142 to be rotated in conjunction with the anilox roll 142. The cleaning liquid retained on the surface of the anilox roll 142 is transferred to the intermediate roll 148.

The transfer roll 150, which is a roll having a width corresponding to that of the intermediate roll 148, is brought into contact with the intermediate roll 148 to be rotated in conjunction with the intermediate roll 148. Therefore, the cleaning liquid retained on the surface of the intermediate roll 148 is transferred to the surface of the transfer roll 150.

At this time, the transfer roll 150 is in contact with the wiping web 112 to be rotated in the same direction as the conveying direction of the wiping web 112. Therefore, the cleaning liquid transferred from the surface of the intermediate roll 148 to the surface of the transfer roll 150 is supplied to the wiping web 112. This makes the cleaning liquid absorbed into the wiping web 112.

The cleaning liquid tray 144 is coupled via the cleaning liquid pipe 154 to the cleaning liquid tank 152. The cleaning liquid pump 156, which is provided in the middle way of the cleaning liquid pipe 154, sends the cleaning liquid reserved in the cleaning liquid tank 152 to the cleaning liquid tray 144.

Here, the cleaning liquid tank 152 and the cleaning liquid pump 156 are configured to be provided for one wiping unit 100, but one cleaning liquid tank and one cleaning liquid pump may be configured to be used in common by the wiping units 100C, 100M, 100Y, and 100K. In this case, the cleaning liquid sent by one cleaning liquid pump is supplied to the cleaning liquid trays 144C, 144M, 144Y, and 144K of the wiping units 100C, 100M, 100Y, and 100K, respectively, and used by the respective anilox rolls 142C, 142M, 142Y, and 142K.

The configuration for supplying the cleaning liquid to the wiping web 112 is not limited to the example illustrated in FIG. 5, but any configuration may be employed so long as the wiping web 112 is supplied with the cleaning liquid in a certain amount.

(Electrical Configuration of Nozzle Surface Cleaning Device)

Figure 6:
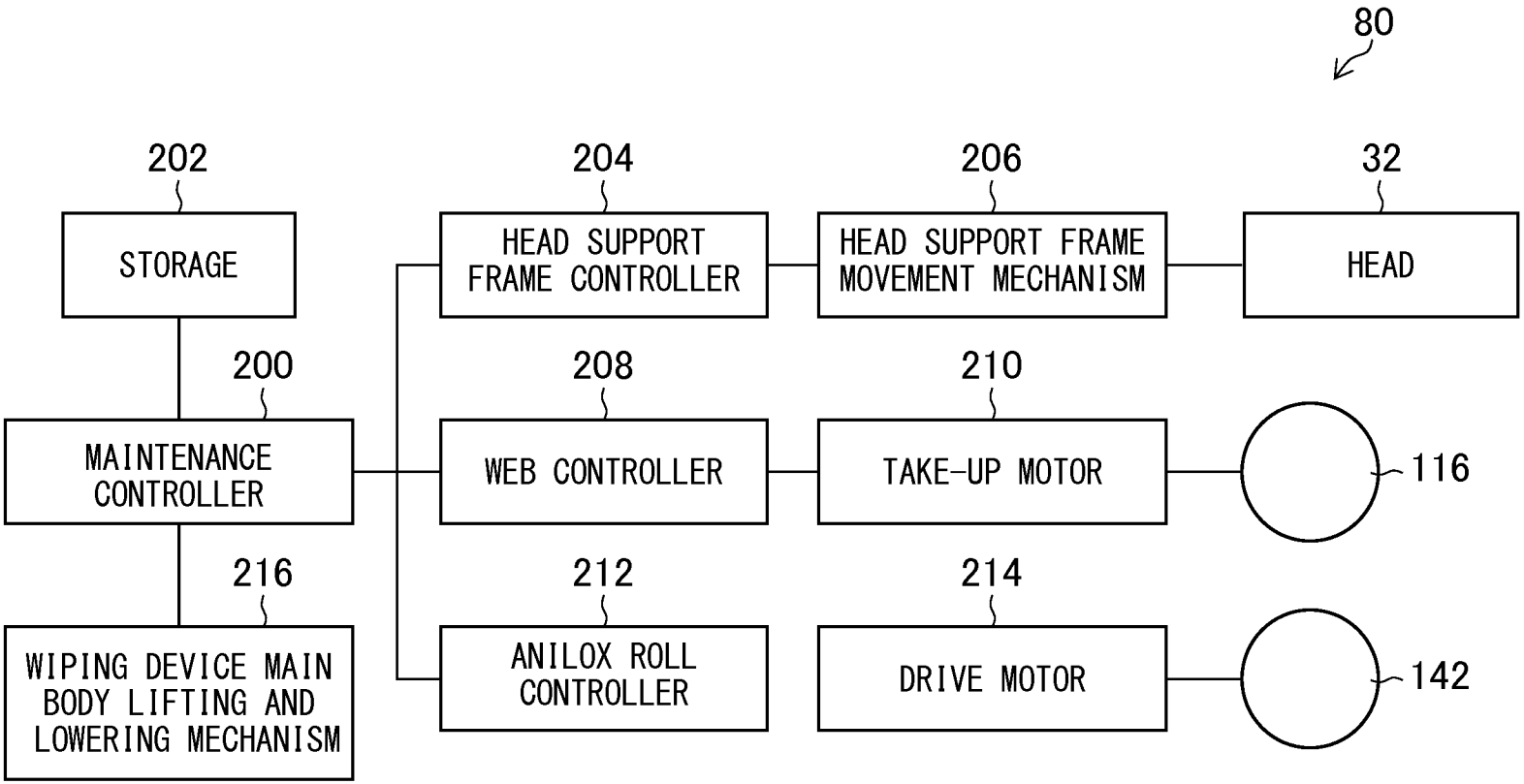
FIG. 6 is a block diagram illustrating an electrical configuration of a nozzle surface cleaning device.

FIG. 6 is a block diagram illustrating an electrical configuration of the nozzle surface cleaning device 80. The nozzle surface cleaning device 80 includes a maintenance controller 200, storage 202, head support frame controller 204, head support frame movement mechanism 206, web controller 208, take-up motor 210, anilox roll controller 212, drive motor 214, wiping device main body lifting and lowering mechanism 216.

The maintenance controller 200 (an example of a control unit) controls a wiping timing for the head 32 and generally controls the nozzle surface cleaning device 80. The storage 202 stores therein various parameters necessary for the maintenance controller 200.

The head support frame controller 204 controls the head support frame movement mechanism 206 in accordance with an instruction from the maintenance controller 200 to control a movement speed of the head 32.

The web controller 208 controls the take-up motor 210 in accordance with an instruction from the maintenance controller 200 to control a take-up speed of the take-up side web core 116. This controls a traveling speed of the wiping web 112.

The anilox roll controller 212 controls the drive motor 214 in accordance with an instruction from the maintenance controller 200 to control a rotation speed of the anilox roll 142. This controls an amount of the cleaning liquid supplied from the anilox roll 142 to wiping web 112.

The nozzle surface cleaning device 80 is configured to be generally liftable by the wiping device main body lifting and lowering mechanism 216. The maintenance controller 200 controls the wiping device main body lifting and lowering mechanism 216 to lift and lower a main body of the nozzle surface cleaning device 80.

(Workings of Nozzle Surface Cleaning Device)

Next, a description is given of workings of the nozzle surface cleaning device 80 configured as above.

Operation of the nozzle surface cleaning device 80 is controlled by the maintenance controller 200. The maintenance controller 200 wipes and cleans the nozzle surface 33 by the wiping unit 100 in the course of moving the head 32 from the image recording position to the maintenance position.

The maintenance controller 200 controls the wiping device main body lifting and lowering mechanism 216 such that the nozzle surface cleaning device 80 is made to stand by at a predetermined standby position other than during cleaning and to lift during cleaning to a predetermined operation position which is a position lifted from the standby position by a predetermined amount.

In a state where the nozzle surface cleaning device 80 is positioned at the operation position, each wiping unit 100 can wipe the nozzle surface 33 of each head 32. In other words, while the head 32 is passed through the wiping unit 100 by the head support frame movement mechanism 206 (an example of a sliding unit), the wiping web 112 wrapped on the press roll 122 can be pressed to and brought into contact with the nozzle surface 33 of the head 32.

The maintenance controller 200 controls the head support frame controller 204 to control the head support frame movement mechanism such that the head 32 is moved to the maintenance position.

The maintenance controller 200 controls conveyance of the wiping web 112 by the conveying unit 110 correspondingly to a timing when each head 32 reaches the wiping unit 100. In other words, driving of the take-up motor 210 is started. This allows the wiping web 112 to be fed out from the feed side web core 114, travel, and be taken up by the take-up side web core 116.

At this time, the feed shaft of the feed side web core 114 is given a friction by the friction mechanism, while the take-up shaft of the take-up side web core 116 slides on receiving a load of a certain level put by the torque limiter, such that the wiping web 112 can be given a certain tension to travel.

The maintenance controller 200 controls the cleaning liquid supply unit 140 at the same time as the wiping web 112 traveling to make the wiping web 112 wetted by the cleaning liquid. In other words, the anilox roll controller 212 starts controlling.

The cleaning liquid reserved in the cleaning liquid tank 152 is sent to the cleaning liquid tray 144 of the cleaning liquid supply unit 140 by the cleaning liquid pump 156.

The anilox roll 142, a part of which is immersed in the cleaning liquid reserved in the cleaning liquid tray 144, retains the cleaning liquid in the cells on the surface thereof immersed. The anilox roll 142, in conjunction with rotating by the drive motor 214, draws the cleaning liquid retained in the cells thereof from the cleaning liquid tray 144. The cells on the surface newly immersed in the cleaning liquid are filled with the cleaning liquid.

The doctor blade 146 is brought into contact with the rotating anilox roll 142 such that the cleaning liquid excess on the surface of the anilox roll 142 is removed while the cleaning liquid is retained in the cells.

In this way, the cleaning liquid is measured by the anilox roll 142 and the doctor blade 146.

The measured cleaning liquid is transferred to the intermediate roll 148. The cleaning liquid transferred to the intermediate roll 148 is again transferred to the transfer roll 150 which is brought into contact with the intermediate roll 148 to be rotated. At this time, the transfer roll 150 brought into contact with the wiping web 112 to be rotated at the same speed as the traveling speed of the wiping web 112 transfers and supplies the cleaning liquid transferred from the intermediate roll 148 to the wiping web 112.

In this way, the cleaning liquid measured by the anilox roll 142 and the doctor blade 146 is supplied to the wiping web 112 in a certain amount.

The cleaning liquid amount for the wiping web 112 can be adjusted by controlling the rotation speed of the anilox roll 142. For example, if the rotation speed of the anilox roll 142 is raised, the rotation speed of the transfer roll 150 becomes faster than the traveling speed of the wiping web 112 and slip occurs between the surface of the transfer roll 150 and the surface of the wiping web 112 to increase the cleaning liquid amount supplied to the wiping web 112. In this embodiment, the cleaning liquid is supplied in an amount which gets the wiping web 112 into a saturated condition. The saturated condition is a condition where the wiping web 112 is maximally impregnated with the cleaning liquid.

The wiping web 112 supplied with the cleaning liquid in a certain amount is guided toward the press roll 122 by the second guide roll 120 to be pressed to and brought into contact with the nozzle surface 33 at the press roll 122 due to traveling driven by the take-up motor 210. At this time, the head 32 moves by the head support frame movement mechanism 206. This makes the press roll 122 on which the wiping web 112 is wrapped slide in a state of being pressed to and brought into contact with the nozzle surface 33 to wipe and clean the nozzle surface 33.

At this time, the wiping web 112 travels in a direction opposite to a moving direction of the nozzle surface 33 to wipe the nozzle surface 33. This makes it possible to efficiently wipe the nozzle surface 33. Additionally, a new surface (unused area) of the wiping web 112 can be always used to wipe the nozzle surface 33.

The wiping web 112 after wiping the nozzle surface 33 is taken up by the take-up side web core 116. The head 32 is moved by the head support frame movement mechanism 206 to the maintenance position and the nozzle surface 33 is covered by the cap 42.

(Relationship Between Surface Tension and Viscosity of Mixed Liquid and Presence or Absence of Remaining Liquid)

In the wiping unit 100 configured in this way, an ink mist adhered to the nozzle surface 33 and the cleaning liquid supplied to the wiping web 112 are mixed at a contacting portion between the nozzle surface 33 and the wiping web 112. In the description, the liquid in which the ink and the cleaning liquid are mixed at the contacting portion is referred to as the mixed liquid.

Figure 7:
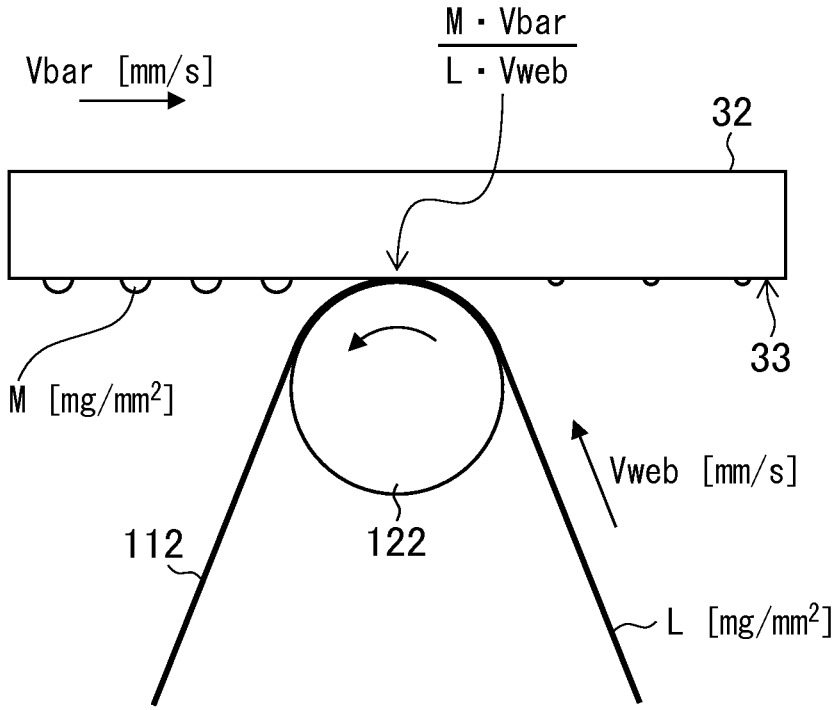
FIG. 7 is an illustration for explaining a mixing ratio for mixed liquid.

FIG. 7 is an illustration for explaining a mixing ratio for the mixed liquid.

Assuming that the movement speed of the head 32 during wiping and cleaning is Vbar [mm/s], an amount of the ink mist adhered to the nozzle surface 33 is M [mg/mm$^2$], the traveling speed of the wiping web 112 (conveyance speed) is Vweb [mm/s], and an amount of the cleaning liquid supplied to the wiping web from the transfer roll 150 (water-holding amount) is L [mg/mm$^2$], a mixing ratio R of the mixed liquid of the cleaning liquid and the ink at the contacting portion between the nozzle surface 33 and the wiping web 112 is expressed as below.

$$R=\text{ink inflow amount/cleaning liquid inflow amount}=M*V\text{bar}/(L*V\text{web}) \quad \text{(Formula 1)}$$

Figure 8:
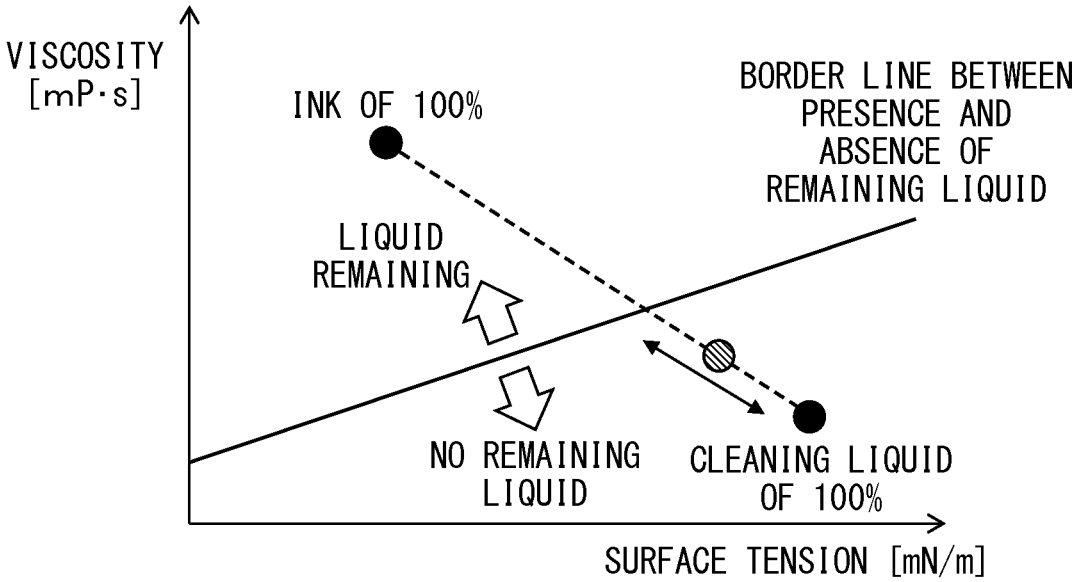
FIG. 8 is a graph illustrating a relationship between mixed liquid properties and presence or absence of remaining liquid on the nozzle surface.

FIG. 8 is a graph illustrating a relationship between mixed liquid properties (physical properties) and presence or absence of remaining liquid on the nozzle surface 33 during wiping and cleaning. Here, a graph having an abscissa axis of surface tension [mN/m] of the mixed liquid and an ordinate axis of viscosity [mP·s] of the mixed liquid is illustrated and the presence or absence of remaining liquid is illustrated on the graph.

As illustrated in FIG. 8, a relationship between surface tension and viscosity of the mixed liquid in a case where a certain ink and a certain cleaning liquid are used varies depending on the mixing ratio R thereof on a line connecting a plotted point at a surface tension and viscosity of the ink of 100% and a plotted point at a surface tension and viscosity of the cleaning liquid of 100%.

As the mixing ratio R of the mixed liquid is decreased from the ink of 100% (that is, a ratio of the inflow amount of the cleaning liquid is made larger), the remaining liquid on the nozzle surface 33 after wiping by the wiping web 112 disappears at a certain mixing ratio. A border line between the presence and absence of remaining liquid varies depending on liquid repellent performance of the nozzle surface 33.

Therefore, regarding the actually used head 32, experiments for confirming the presence or absence of remaining liquid by use of various inks and various cleaning liquids can find the border line between the presence and absence of remaining liquid as illustrated in FIG. 8. In the experiments for confirmation, as expressed by Formula 1, the mixing ratio R of the mixed liquid can be adjusted by controlling the movement speed Vbar of the head 32, the ink mist amount M of the nozzle surface 33, the conveyance speed Vweb of the wiping web 112, and the water-holding amount L of the wiping web.

The border line between the presence and absence of remaining liquid found in this way can be formulated as y=f(x), assuming the surface tension is x and the viscosity is y. At this time, in an area expressed by y<f(x), that is, on the lower side of the border line between the presence and absence of remaining liquid illustrated in FIG. 8, no liquid remains. Therefore, the nozzle surface 33 may be wiped and cleaned by controlling at least one of the movement speed Vbar of the head 32, the ink mist amount M of the nozzle surface 33, the conveyance speed Vweb of the wiping web 112, and the water-holding amount L of the wiping web such that a state of the mixed liquid is put into a state satisfying the relationship of y<f(x).

Here, the movement speed Vbar of the head 32 can be controlled by adjusting the movement speed of the head support frame by the head support frame controller 204. In this embodiment, since the head support frame 34 has the heads 32C, 32M, 32Y, and 32K of the respective colors attached thereto, the movement speeds for the respective heads cannot be separately controlled, but another aspect may also be employed in which the head support frame 34 and the head support frame movement mechanism 206 are provided for each head to control the movement speed for each head.

The ink mist amount M of the nozzle surface 33 can be controlled by changing maintenance frequency (time elapsed from the previous maintenance, and the number of printed sheets). In this embodiment, the ink mist amount M of the nozzle surface 33 refers to a value assuming the dirtiest state depending on the time elapsed from the previous maintenance, and the number of printed sheets.

The ink mist amount M of the nozzle surface 33 can be found by imaging the nozzle surface 33 by an image pickup device. In this case, another aspect of configuration may also be employed in which fixed values are given to Vbar, Vweb, and L, and when the ink mist amount M exceeds the predetermined value, the maintenance is performed.

The conveyance speed Vweb of the wiping web 112 can be controlled by adjusting the take-up speed of the take-up motor 210 by the web controller 208. Further, the water-holding amount L of the wiping web 112 can be controlled by adjusting the rotation speed of the drive motor 214 (rotation speed of the anilox roll 142) by the anilox roll controller 212. In this embodiment, the cleaning liquid is supplied in an amount which gets the wiping web 112 into a saturated condition such that the water-holding amount is constant. In this case, the water-holding amount may be adjusted by changing a thickness or material of the wiping web 112 to supply the cleaning liquid in an amount getting the wiping web 112 into the saturated condition.

The nozzle surface cleaning device 80 stores in the storage 202 the formula y=f(x) for the border line between the presence and absence of remaining liquid which corresponds to the liquid repellent performance of the nozzle surface 33 of the head 32 to be used. The maintenance controller 200 calculates the mixing ratio of the mixed liquid satisfying the condition of y<f(x) on the basis of the relationship between the ink and cleaning liquid to be used, and controls the wiping unit 100 so as to satisfy the calculated mixing ratio. Such controlling can prevent increase of the number of the maintenances beyond necessity, excessive use of the cleaning liquid caused by supplying the cleaning liquid beyond necessity, excessive use of the wiping web 112 caused by speeding up the conveyance of the wiping web 112 beyond necessity, and increase of the maintenance time period caused by slowing down the movement speed of the head beyond necessity.

A configuration may be employed in which various control parameters for Vbar, M, Vweb, and L are input via an input part (not illustrated) such that the state of the mixed liquid is put into a state satisfying the relationship of y<f(x).

Figure 9:
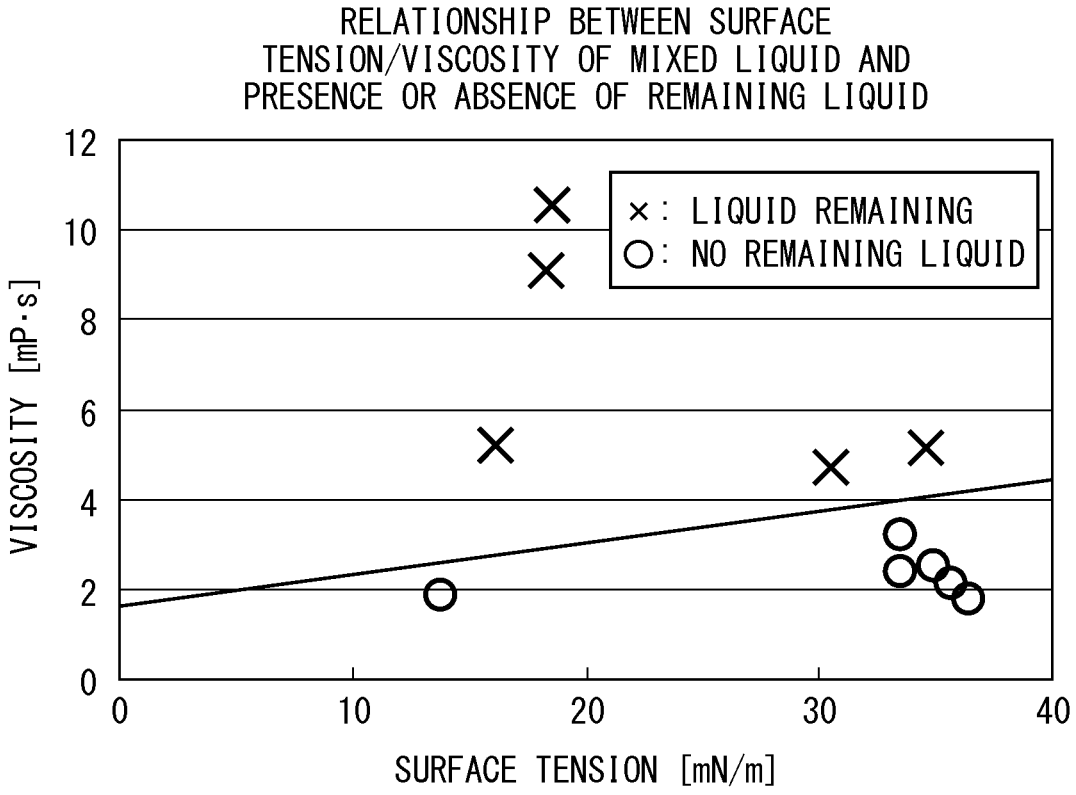
FIG. 9 is a graph illustrating a found border line between presence and absence of the remaining liquid.

FIG. 9 is a graph illustrating a found border line between the presence and absence of remaining liquid which is plotted using a circle in a case of the liquid remaining and a cross in a case of no remaining liquid regarding mixed liquids, for the nozzle surface 33 having a certain liquid repellent performance. In this case, the border line between the presence and absence of remaining liquid can be expressed as below.

$$y=f(x)=0.07x+1.72 \quad \text{(Formula 2)}$$

Accordingly, in a case of using the head 32 having this nozzle surface 33, no remaining liquid on the nozzle surface 33 after wiping and cleaning can be achieved by controlling at least one of Vbar, M, Vweb, and L such that the state of the mixed liquid is put into a state satisfying the relationship of y<f(x).

This can prevent the problems from occurring, for example, the mixed liquid is connected with meniscus of the nozzle, the mixed liquid remaining on the nozzle surface is dried and gets into the nozzle in wiping next time, a long time contact between the nozzle surface and the mixed liquid causes a liquid repellent film of the nozzle surface to deteriorate, and the like. Therefore, the printing accuracy by way of the head 32 can be stabilized.

The technical scope of the present invention is not limited the scope of the embodiments described above. The configurations and the like in the embodiments can be appropriately combined across the embodiments within the scope not departing from the gist of the present invention.

What is claimed is:

1. An inkjet head cleaning device for an inkjet head having a nozzle surface on which nozzles configured to eject ink are arranged, comprising:

a wiping member traveling unit allowing a wiping member of elongated shape having absorbency to travel along a conveying path in a longitudinal direction;

a cleaning liquid supply unit configured to supply a cleaning liquid to the wiping member;

a pressing unit configured to press and bring the wiping member supplied with the cleaning liquid to and into contact with the nozzle surface;

a sliding unit configured to relatively slide the wiping member pressed on to the nozzle surface by the pressing unit and the nozzle surface;

a storage configured to store a relationship represented by a surface tension and viscosity of a mixed liquid of the ink and the cleaning liquid, wherein the relationship represents a border between presence and absence of residue after cleaning the nozzle surface, the border depending on liquid repellent performance of the nozzle surface;

a unit configured to calculate a mixing ratio of the mixed liquid by which a condition of the absence of the residue is satisfied, from the relationship of the border; and a controller configured to control at least one of Vweb, L, Vbar and a cleaning frequency of the inkjet head so that R satisfies the calculated mixing ratio, wherein M $mg/mm^2$ is an amount of the ink adhered to the nozzle surface, Vweb mm/s is a traveling speed of the wiping member by the wiping member traveling unit, L $mg/mm^2$ is an amount of the cleaning liquid supplied to the wiping member by the cleaning liquid supply unit, Vbar mm/s is a relative movement speed between the wiping member and the nozzle surface which are relatively slid by the sliding unit, R is a mixing ratio of the mixed liquid of the cleaning liquid and the ink at a contacting portion between the nozzle surface and the wiping member upon cleaning the nozzle surface, and R is expressed by R=M*Vbar/(L*Vweb);

wherein the relationship represented by the surface tension and viscosity of the mixed liquid is a relationship calculated by experimentally finding the presence or absence of the residue on the nozzle surface upon cleaning the nozzle surface regarding a plurality of mixed liquids different in the surface tension and the viscosity; and the relationship representing the border between the presence and absence of the residue is a border line between a presence and absence of a residue calculated from a graph plotting a result obtained from the presence or absence of the residue regarding the plurality of mixed liquids with an abscissa axis of surface tensions of various mixed liquids and an ordinate axis of viscosities of the mixed liquid.

2. The inkjet head cleaning device according to claim 1, wherein the cleaning liquid supply unit supplies the cleaning liquid in an amount which gets the absorbency of the wiping member into a saturated condition.

3. The inkjet head cleaning device according to claim 1, wherein the control unit controls the cleaning frequency of the inkjet head assuming a state where the ink maximally adheres to the nozzle surface.

4. An inkjet printing device, comprising:

an inkjet head having a nozzle surface on which nozzles for ejecting ink are arranged;

a recording unit relatively moving the inkjet head and a recording medium while ejecting the ink from the nozzle for recording on the recording medium; and the inkjet head cleaning device according to claim 1.

5. The inkjet printing device according to claim 4, further comprising:

a wetting unit configured to wet the nozzle of the inkjet head; and a moving unit configured to move the inkjet head between a recording position for recording on the recording medium by the recording unit and a wet position for wetting the nozzle by the wetting unit, wherein the inkjet head cleaning device is arranged between the recording position and the wet position.

6. A cleaning method of an inkjet head having a nozzle surface on which nozzles configured to eject ink are arranged, comprising:

a wiping member traveling step of allowing a wiping member of elongated shape having absorbency to travel along a conveying path in a longitudinal direction;

a cleaning liquid supply step of supplying a cleaning liquid to the wiping member;

a pressing step of pressing and bringing the wiping member supplied with the cleaning liquid to and into contact with the nozzle surface;

a sliding step of relatively sliding the wiping member pressed on to the nozzle surface and the nozzle surface;

a step of obtain a relationship represented by a surface tension and viscosity of a mixed liquid of the ink and the cleaning liquid, from a storage, wherein the relationship represents a border between presence and absence of residue after cleaning the nozzle surface, the border depending on liquid repellent performance of the nozzle surface, and calculating a mixing ratio of the mixed liquid by which a condition of the absence of the residue is satisfied; and a step of controlling at least one of Vweb, L, Vbar and a cleaning frequency of the inkjet head so that R satisfies the calculated mixing ratio, wherein M $mg/mm^2$ is an amount of the ink adhered to the nozzle surface, Vweb mm/s is a traveling speed of the wiping member in the wiping member traveling step, L $mg/mm^2$ is an amount of the cleaning liquid supplied to the wiping member in the cleaning liquid supply step, Vbar mm/s is a relative movement speed between the wiping member and the nozzle surface which are relatively slid in the sliding step, R is a mixing ratio of the mixed liquid of the cleaning liquid and the ink at a contacting portion between the nozzle surface and the wiping member upon cleaning the nozzle surface, and R is expressed by R=M*Vbar/(L*Vweb);

wherein the relationship represented by the surface tension and viscosity of the mixed liquid is a relationship calculated by experimentally finding the presence or absence of the residue on the nozzle surface upon cleaning the nozzle surface regarding a plurality of mixed liquids different in the surface tension and the viscosity; and the relationship representing the border between the presence and absence of the residue is a border line between a presence and absence of a residue calculated from a graph plotting a result obtained from the presence or absence of the residue regarding the plurality of mixed liquids with an abscissa axis of surface tensions of various mixed liquids and an ordinate axis of viscosities of the mixed liquid.

* * * * *